US006866485B2

(12) United States Patent
Hansen et al.

(10) Patent No.: US 6,866,485 B2
(45) Date of Patent: Mar. 15, 2005

(54) DOUBLE-ACTING HYDRAULIC PRESSURE INTENSIFIER

(75) Inventors: Leif Hansen, Sønderborg (DK); Peter J. M. Clausen, Nordborg (DK); Christen Esperson, Augustenborg (DK); Jan Petersen, Egernsund (DK)

(73) Assignee: miniBOOSTER HYDRAULICS A/S, Sønderborg (DK)

( * ) Notice: Subject to any disclaimer, the term of this patent is extended or adjusted under 35 U.S.C. 154(b) by 133 days.

(21) Appl. No.: 10/305,328

(22) Filed: Nov. 26, 2002

(65) Prior Publication Data

US 2003/0099556 A1 May 29, 2003

(30) Foreign Application Priority Data

Nov. 28, 2001 (DE) ..... 101 58 182

(51) Int. Cl.[7] ..... F04B 17/00; F01L 25/04
(52) U.S. Cl. ..... 417/225; 91/300; 91/297
(58) Field of Search ..... 417/225; 91/282, 91/290, 297, 300, 301, 335

(56) References Cited

U.S. PATENT DOCUMENTS 2,508,298 A 5/1950 Saari
4,523,895 A 6/1985 Silva
4,659,294 A 4/1987 Barthomeuf
4,780,064 A 10/1988 Olsen

FOREIGN PATENT DOCUMENTS

DE 3032430 6/1987
GB 1420424 1/1976

*Primary Examiner*—Charles G. Freay
(74) *Attorney, Agent, or Firm*—Friedrich Kueffner

(57) ABSTRACT

A double-acting hydraulic pressure intensifier includes a supply connection, a return connection, a high-pressure connection. An intensifier piston assembly includes a low-pressure piston arranged in a low-pressure cylinder and two high-pressure pistons connected to the low-pressure piston each arranged in a high-pressure cylinder. A switching valve assembly includes a displace able, hydraulically controlled valve element which on its two opposite sides in the direction of displacement has control pressure chambers with pressure application areas of different sizes, namely, a first control pressure chamber with a smaller pressure application area and a second control pressure chamber with a larger pressure application area. A stop plug is arranged between the second control pressure chamber and the supply connection.

10 Claims, 8 Drawing Sheets

DOUBLE-ACTING HYDRAULIC PRESSURE INTENSIFIER

BACKGROUND OF THE INVENTION

1. Field of the Invention

The present invention relates to a double-acting hydraulic pressure intensifier with a supply connection, a return connection, a high-pressure connection, an intensifier piston assembly comprising a low-pressure piston in a low-pressure cylinder and two high-pressure pistons connected to the low-pressure piston each in a high-pressure cylinder, and with a switching valve assembly comprising a displaceable, hydraulically controlled valve element which on its two opposite sides in the direction of displacement comprises control pressure chambers with pressure application areas of different size, namely a first control pressure chamber with a smaller pressure application area and a second control pressure chamber with a larger pressure application area.

2. Description of the Related Art

A double-acting hydraulic pressure intensifier of this kind is known from U.S. Pat. No. 4,659,294. The switching valve comprises a valve slide which can be displaced to and fro in a housing under the action of pressures which act on its two end faces. The pressures are equal here. The forces required to move the valve slide are applied by the fact that the pressures act on pressure application areas of different size. The valve slide controls the delivery of fluid to the low-pressure cylinder, this being alternately to one or the other side of the low-pressure piston. In the high-pressure cylinders is then generated a pressure which corresponds to the pressure at the supply connection multiplied by the ratio of the working areas of low-pressure piston and high-pressure piston.

A further double-acting hydraulic pressure intensifier is known from U.S. Pat. No. 2,508,298. Here, even two low-pressure pistons with two high-pressure pistons which move in opposite directions are provided. Each low-pressure piston is controlled by a switching valve, wherein the two switching valves operate in dependence upon each other.

Double-acting hydraulic pressure intensifiers of this kind have basically been tried and tested. They are capable of raising to a higher pressure the fluid which is at the supply connection at a lower pressure, wherein naturally the fluid quantity which is then available at the higher pressure is smaller.

However, the following problem often arises during operation: when the fits are very close, in particular in the case of the switching valve, high friction losses arise. The pressure intensifier can then operate only at a relatively low working frequency, which reduces the fluid quantity available at higher pressure. If on the other hand greater tolerances are provided, then the switching valve and hence also the low-pressure piston can of course move to and fro more rapidly. But in return the leaks at the switching valve are correspondingly greater. This in turn results in the valve element of the switching valve under certain circumstances remaining not long enough in positions which are necessary for the low-pressure piston to perform a sufficiently large stroke of movement. In such cases it can happen that the pressure intensifier catches, that is, stops working.

SUMMARY OF THE INVENTION

It is the primary object of the present invention to increase the reliability.

In accordance with the present invention, this object is met in a double-acting hydraulic pressure intensifier of the kind described above by arranging a stop plug between the second control pressure chamber and the supply connection.

Via this stop plug, the second control pressure chamber can be filled with fluid under the pressure at the supply connection. As the second control pressure chamber is provided with the large pressure application area, due to this design the valve is also then held reliably in the end position which is predetermined by the second control pressure chamber when leaks occur. The only precondition is that the stop plug allows greater fluid throughflow than is lost due to the leaks. The pressure of the supply connection is therefore essentially trapped in the second control chamber when the valve element has been displaced into the corresponding position. Erroneous or defective switching of the valve element to the other position on account of a leak cannot take place because the pressure from a higher plane, namely the supply connection, is maintained. If, on the other hand, the second control pressure chamber is relieved of pressure, then the valve element is displaced into its other end position under the action of the pressure in the first control pressure chamber and so directs the corresponding fluid delivery to the low-pressure cylinder. In the event that in this situation fluid still continues to flow through the stop plug, this likewise does not lead to a critical situation, because a certain time is necessary before a corresponding pressure has built up in the second control pressure chamber. But in this time the switching valve has already reached its next switching state again, in which the pressure in the second control pressure chamber should be at a higher level. The characteristic of the control pressure chambers being arranged on opposite sides of the valve element in the direction of displacement is to be understood functionally here. The valve element is directed or moved by the pressure in one control pressure chamber into one switching position and by the pressure in the other control pressure chamber into another switching position. How this takes place in detail depends on the design of the valve element, e.g. whether it is constructed in one or more parts.

Preferably, the stop plug is arranged in a line which can be shut off. With this embodiment, there can be additional protection against the pressure in the second control pressure chamber being accidentally increased and leading to unwanted switching. In situations in which no pressure increase is to take place in the second control pressure chamber, the line in which the stop plug is arranged is simply shut off. In this case it is particularly preferred that the line which can be shut off is controlled by the valve element. This allows reliable control of shutting off. External means which act on the line are then not necessary. With movement of the valve element the two situations arise automatically in which, on the one hand, the stop plug is released and, on the other hand, the stop plug is blocked.

Preferably, the stop plug is arranged in the valve element. This is a particularly simple embodiment for controlling shut-off of the line. Furthermore, manufacture of the stop plug is relatively easy. Alterations in the housing of the pressure intensifier are not necessary.

In this case it is particularly preferred that the stop plug opens out in the larger pressure application area, on the one hand, and in a circumferential wall of the valve element, on the other hand. The stop plug is then permanently open towards the second control pressure chamber. Its connection with the supply connection then arises by the other stop plug connection in the valve element coming into alignment with a corresponding opening or groove in the housing.

Preferably, the valve element in a first position provides three flow paths, one of which comprises the stop plug, and in a second position provides two flow paths. The two flow paths connect the supply connection to the low-pressure cylinder and connect the low-pressure cylinder to the return connection, respectively. In the first position in addition there is added a path via which the supply connection is connected to the second control pressure chamber.

Preferably, the low-pressure piston serves as a control element for the switching valve assembly. This embodiment is of course known in the art in connection with double-acting hydraulic pressure intensifiers. But on account of the stop plug, those leaks which arise in the region of the low-pressure piston can also be equalized.

Preferably, the low-pressure piston comprises an auxiliary channel which in one position of the low-pressure piston connects the second control pressure chamber to the return connection. Via the auxiliary channel, pressure relief of the second control pressure chamber to the return connection can be produced, so that the pressure in the second control pressure chamber can drop relatively rapidly. The valve element is then displaced in a direction towards the second control pressure chamber. For this purpose, the first control pressure chamber can be permanently connected to the supply connection. The auxiliary channel can for example be formed by a peripheral groove on the low-pressure piston.

It is particularly preferred that the second control pressure chamber is connected to the low-pressure cylinder via a control line comprising a non-return valve, wherein the low-pressure cylinder clears the opening of the control pressure line into the low-pressure cylinder when it is in the region of one of its end positions. With clearing of the control line, the pressure which has displaced the low-pressure piston into the end position acts via the non-return valve on the second control pressure chamber and so displaces the valve element into its other position, so that the low-pressure piston is displaced in the opposite direction again. Of course, in case the pressure supply to the second control pressure chamber via the control line is interrupted. But as the second control pressure chamber is then connected via the stop plug to the supply connection, the pressure in the second control pressure chamber can also be maintained in case of certain leaks, this being until the low-pressure piston has reached its other end position. In this case the pressure in the second control pressure chamber can be reduced via the auxiliary channel, so that the valve element is displaced into its other position again.

Preferably, in the second pilot line is arranged a pilot-controlled non-return valve whose valve control line opens out into the low-pressure cylinder, wherein the low-pressure piston clears the opening of the valve control line when it is in its other end position. In this embodiment, the non-return valve can be used both for supply to the second control pressure chamber and for pressure relief of the second control pressure chamber. Normally, the non-return valve would prevent pressure relief of the second control pressure chamber. But as the non-return valve is pilot-controlled, that is, opened when its valve control line is subjected to the higher pressure in the low-pressure cylinder, the non-return valve can open as needed. The advantage of this embodiment is that the connecting point between the individual lines can be placed closer to the low-pressure cylinder.

In an alternative embodiment it is provided that the low-pressure piston comprises an auxiliary channel which in one position of the low-pressure piston connects the second control pressure chamber to the supply connection. In this case a non-return valve in the corresponding control line is not necessary. Control is effected instead exclusively by the movement of the low-pressure piston.

Preferably, the auxiliary channel in another position of the low-pressure piston connects the second control pressure chamber to the return connection. The auxiliary channel therefore has two functions for this embodiment. It controls both pressurization of the second control pressure chamber and lowering of pressure.

Preferably, the high-pressure connection is connected via a pilot-controlled non-return valve to the return connection. In this case relatively rapid pressure relief of the high-pressure connection can be brought about. This takes place simply by the fact that the non-return valve is opened. Particularly in emergency situations a rapid reaction can be produced relatively easily with this embodiment.

Preferably, the high-pressure cylinders are connected to a first fluid system and the low-pressure cylinder is connected to a second fluid system. For instance, a hydraulic oil can be used to "drive" the pressure intensifier, while the fluid which is raised to the higher pressure is water.

It is particularly preferred that between the high-pressure cylinders and the low-pressure cylinder is provided a sealing zone which is connected to a third fluid system. The third fluid system is preferably pressureless. Fluids which enter the sealing zone are then conducted away immediately before they contaminate the other fluid. For instance, in the third fluid system there can be an oil and water mixture.

In a preferred embodiment it is provided that the second control pressure chamber is connected via a high-pressure control line to a high-pressure cylinder, wherein the high-pressure piston arranged in the high-pressure cylinder clears the opening of the high-pressure control line in the end position in which the high-pressure cylinder has its greatest volume. The switching valve assembly can therefore also be controlled by the high-pressure side of the intensifier piston, which under certain circumstances can considerably shorten the switching time of the switching valve assembly.

Preferably, the switching valve assembly comprises two shuttle valves each with a valve element. The two low-pressure chambers of the low-pressure cylinder can then be supplied with pressure independently of each other, at least over a section, which can be used for example to reduce the tendency of the pressure intensifier to vibrate.

It is particularly preferred that the valve element of one shuttle valve switches after switching of the valve element of the other shuttle valve. As a result a time delay is introduced, so that for a short time a pressure prevails on both sides of the low-pressure piston. This ensures that the valve element of one shuttle valve has adopted the correct position before the pressure at the low-pressure piston is changed.

Preferably, each shuttle valve comprises its own control pressure chambers, wherein at least the second control pressure chambers are separated from each other. This is a relatively simple option for making the pressurization of the two valve elements different.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
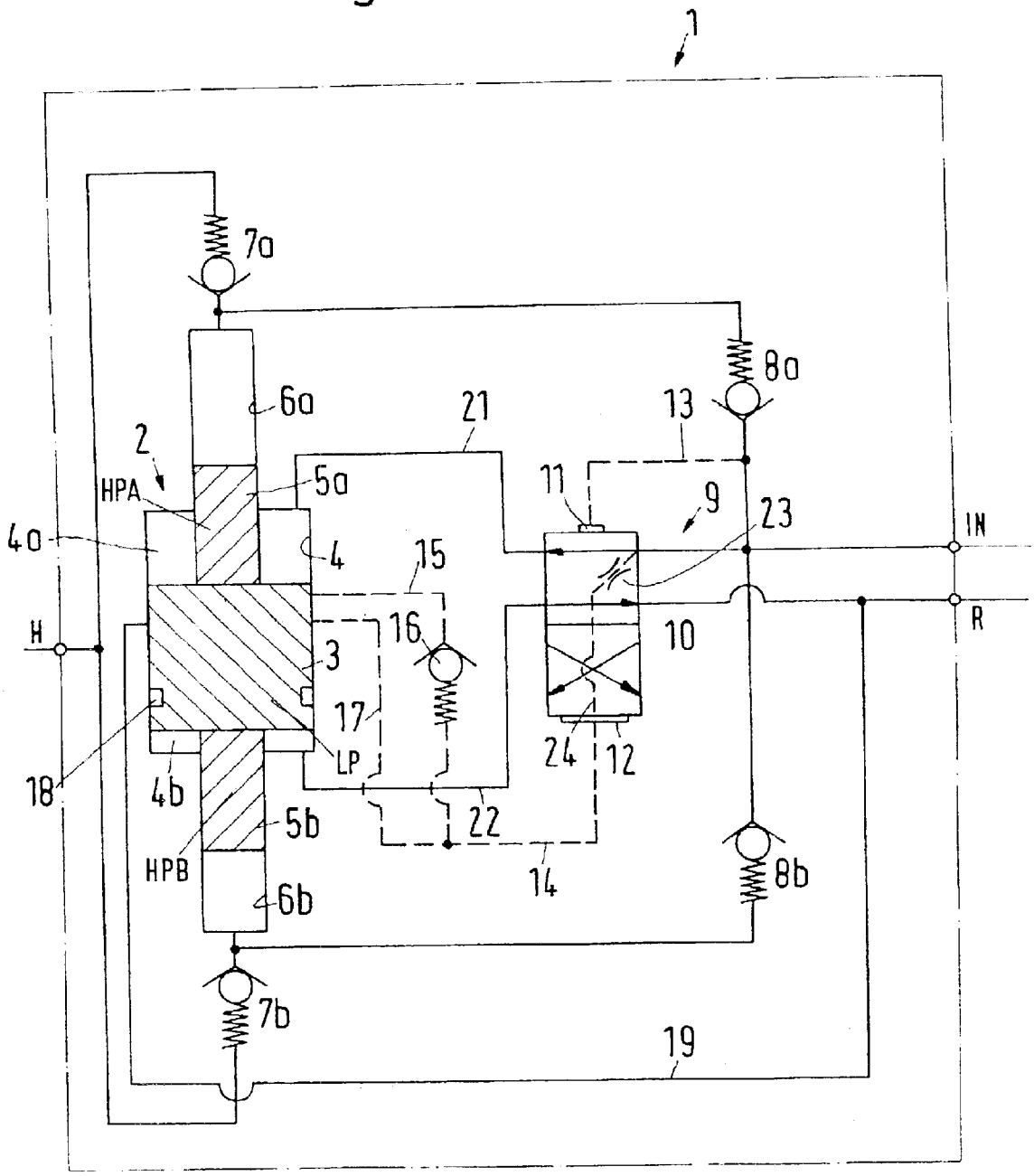
FIG. 1 is a schematic view of a first embodiment of a double-acting hydraulic pressure intensifier.

A double-acting hydraulic pressure intensifier 1 shown schematically in FIG. 1 comprises a supply connection IN, a return connection R and a high-pressure connection H. Via the supply connection IN, fluid is delivered under a predetermined pressure which can for example be generated by a traditional pump.

The pressure intensifier 1 comprises an intensifying piston assembly 2 with a low-pressure piston 3 which is movable to and fro in a low-pressure cylinder 4, i.e. up and down referred to the orientation in FIG. 1, and divides the low-pressure cylinder 4 into a first low-pressure chamber 4*a* and a second low-pressure chamber 4*b*. Connected to the low-pressure piston 3 on mutually opposed sides are two high-pressure pistons 5*a*, 5*b* which are movable in high-pressure cylinders 6*a*, 6*b*, wherein control of movement is effected via the low-pressure piston 3.

The high-pressure cylinders 6*a*, 6*b* are connected via non-return valves 7*a*, 7*b* to the high-pressure connection H, wherein the non-return valves 7*a*, 7*b* open towards the high-pressure connection H. The supply connection IN is connected via non-return valves 8*a*, 8*b* likewise to the high-pressure cylinders 6*a*, 6*b*, wherein the non-return valves 8*a*, 8*b* open to the high-pressure cylinders 6*a*, 6*b*. Via the non-return valves 8*a*, 8*b*, filling of the high-pressure cylinders 6*a*, 6*b* is possible when the high-pressure pistons 5*a*, 5*b* move in a direction in which the high-pressure cylinders 6*a*, 6*b* are increased in size. Emptying of the high-pressure cylinders 6*a*, 6*b* is effected via the non-return valves 7*a*, 7*b*. In this case an increase in size of the high-pressure cylinder 6*a* takes place synchronously with a decrease in size of the high-pressure cylinder 6*b*, and vice versa. With this double-acting pressure intensifier, therefore, interruptions in the provision of fluid under elevated pressure are avoided or at least kept small.

For control of movement of the low-pressure piston 3, a switching valve assembly 9 comprising a valve element 10 is provided. The valve element 10, for example a slide, is controlled on one side by a pressure in a first control pressure chamber 11 and on the opposite side by the pressure in a second control pressure chamber 12. For reasons of clarity, the two control pressure chambers 11 are here shown only as blocks. But it can be seen that the first control pressure chamber acts on the valve element 10 via a smaller pressure application area than the second control pressure chamber, which acts on the valve element via a larger pressure application area. For example, the pressure application area in the second control pressure chamber 12 can be twice as large as in the first control pressure chamber 11.

The first control pressure chamber 11 is permanently connected to the supply connection IN via a first pilot line 13. The second control pressure chamber 12 is connected to a second pilot line 14. This pilot line 14 comprises a first branch 15 with a non-return valve 16, wherein the non-return valve 16 opens towards the second control pressure chamber 12. The branch 15 opens out into the wall of the low-pressure cylinder 4. This opening is cleared when the low-pressure piston 3 is in an end position or, to be more precise, in the end position in which the high-pressure cylinder 6*b* has assumed its smallest volume.

The second pilot line 14 comprises a second branch 17 which likewise opens out into the low-pressure cylinder 4 and in the other end position of the low-pressure piston 3 comes into alignment with a peripheral groove 18 on the low-pressure piston 3 which in this position simultaneously comes into alignment with a return line 19 which correspondingly connects the groove 18 to the return connection R. The groove 18 forms an auxiliary channel.

The switching valve assembly is connected on its input side to the supply connection IN and to the return connection R. On its output side the switching valve assembly 9 comprises a first line 21 which is connected to the low-pressure chamber 4*a*, and a second line 22 which is connected to the second low-pressure chamber 4*b*.

In the position of the valve element 10 shown in FIG. 1, the switching valve assembly 9 connects the input connection IN to the first low-pressure chamber 4*a* and the second low-pressure chamber 4*b* to the return connection R, so that the low-pressure piston 3 is moved downwards under the pressure at the supply connection IN. In the other position of the valve element 10, the second low-pressure chamber 4*b* is connected to the supply connection IN, while the first low-pressure chamber 4*a* is connected to the return connection R, so that the low-pressure piston 3 is moved upwards again under the action of the pressure occurring at the supply connection IN.

Further, a stop plug 23 is provided in a line 24 which connects the supply connection IN to the second control pressure chamber 12. The line 24 with the stop plug 23 is here shown in the valve element 10, of course. But it can also be arranged outside the valve element 10.

The pressure intensifier 1 operates as follows:

Let it first be assumed that the second control pressure chamber 12 is pressureless. The pressure at the supply connection IN delivered via the first pilot line 13 of the first control pressure line 11 therefore moves the valve element 10 of the switching valve assembly 9 into the position shown. The low-pressure piston 3 is therefore moved downwards under the pressure at the supply connection. In this time a small pressure can build up in the second control pressure chamber 12 via the stop plug 23, which pressure is however non-critical.

As soon as the low-pressure piston 3 clears the opening of the branch 15 of the second pilot line 14, a pressure is built up in the second control pressure chamber 12 relatively rapidly via the non-return valve 16, wherein this pressure corresponds to the pressure in the first low-pressure chamber 4*a* and hence to the pressure at the supply connection IN. The pressures in the two control pressure chambers 11, 12 are therefore equal, of course. But as the pressure in the second control pressure chamber 12 acts via a larger pressure application area, the valve element 10 is displaced into its other position, so that now the second low-pressure chamber 4*b* is supplied with fluid under the pressure at the supply connection IN, while the first low-pressure chamber 4*a* is relieved of pressure via the return connection R. The low-pressure piston 3 moves upwards in the process. The valve element 10 of the switching valve assembly remains in this position because the pressure in the second control pressure chamber 12 is always kept via the stop plug 23 at the level at the supply connection IN, even if leaks occur here.

When the low-pressure piston 3 has reached its other end position, the second control pressure chamber 12 is relieved of pressure to the return connection R via the groove 18 and the return line 19, so that the pressure in the second control pressure chamber 12 drops suddenly and the valve element 10 is displaced into the position shown again under the action of the pressure in the first control pressure chamber 11. The cycle of movement of the low-pressure piston 3 and valve element 10 in this case begins again.

When the second control pressure chamber 12 is relieved of pressure, the stop plug 23 and the fluid still conducted over it have no adverse effect, because the fluid can flow away to the return connection R via the second pilot line 14, its branch 17, the groove 18 and the return line 19 substantially faster than it can carry on flowing through the stop plug 23.

Figure 2:
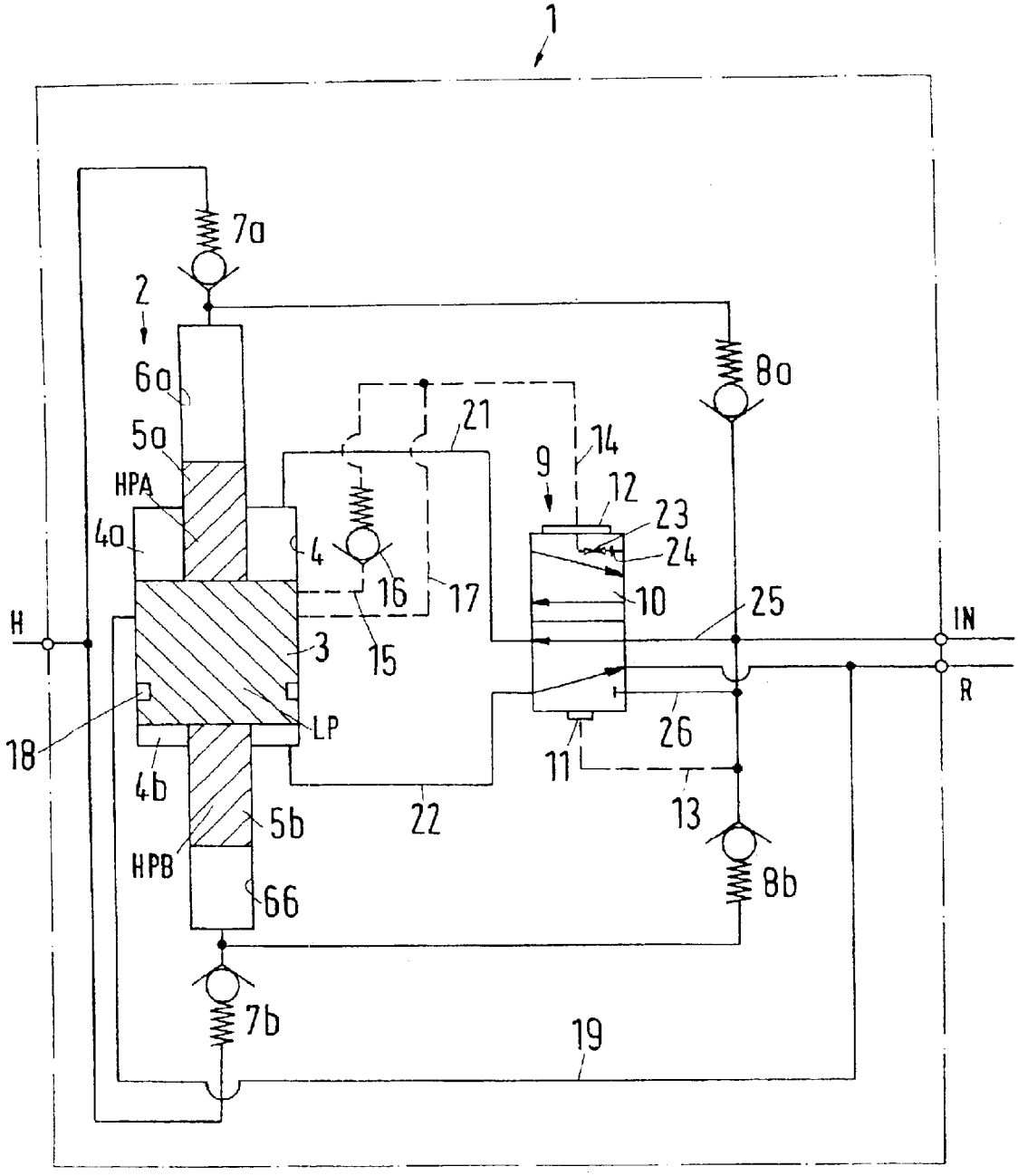
FIG. 2 is a schematic view of a second embodiment of a double-acting hydraulic pressure intensifier.

FIG. 2 shows a modified embodiment in which identical and corresponding parts are given the same reference numbers.

Basically, only the valve element 10 has changed. The line 24 with the stop plug 23 is now arranged in the valve element 10, so that the line 24 is shut off when the valve element 10 is in the position shown in FIG. 2. In this case, therefore, there is no further pressure build-up in the second control pressure chamber 12. The line 24 here opens out in the end face of the valve element 10 which cooperates with the second control pressure chamber 12, that is, in the larger pressure application area. The line 24 opens out on the other side in the circumferential wall of the valve element 10, this being at a position where it comes into alignment with a line 25 to the supply connection IN when the valve element 10 is displaced into its other position.

While in the embodiment of FIG. 1 the switching valve of the switching valve assembly 9 was designed as a 4/2 valve, it is now a 5/2 valve. The 5/2 valve in its position shown in FIG. 2 provides two flow paths, namely from the supply connection IN via the line 25 and the line 21 to the first low-pressure chamber 4*a*, and from the second low-pressure chamber 4*b* via the line 22 to the return connection R. In its other position the valve element 10 provides three flow paths, namely from the supply connection IN via the lines 25, 22 to the second low-pressure chamber 4*b* and via the line 21 to the return connection R. In addition, a flow path is provided from the supply connection IN via the line 25, the line 24 and the stop plug 23 to the second control pressure chamber 12.

Therefore, when the valve element 10 is in the other position not shown in FIG. 2, it becomes self-locking because of the stop plug 23, even when leaks from the second control pressure chamber 12 occur; this takes place until the pressure in the second control pressure chamber 12 is deliberately lowered by a short circuit via the lines 17, 19 and the auxiliary channel 18.

Figure 3:
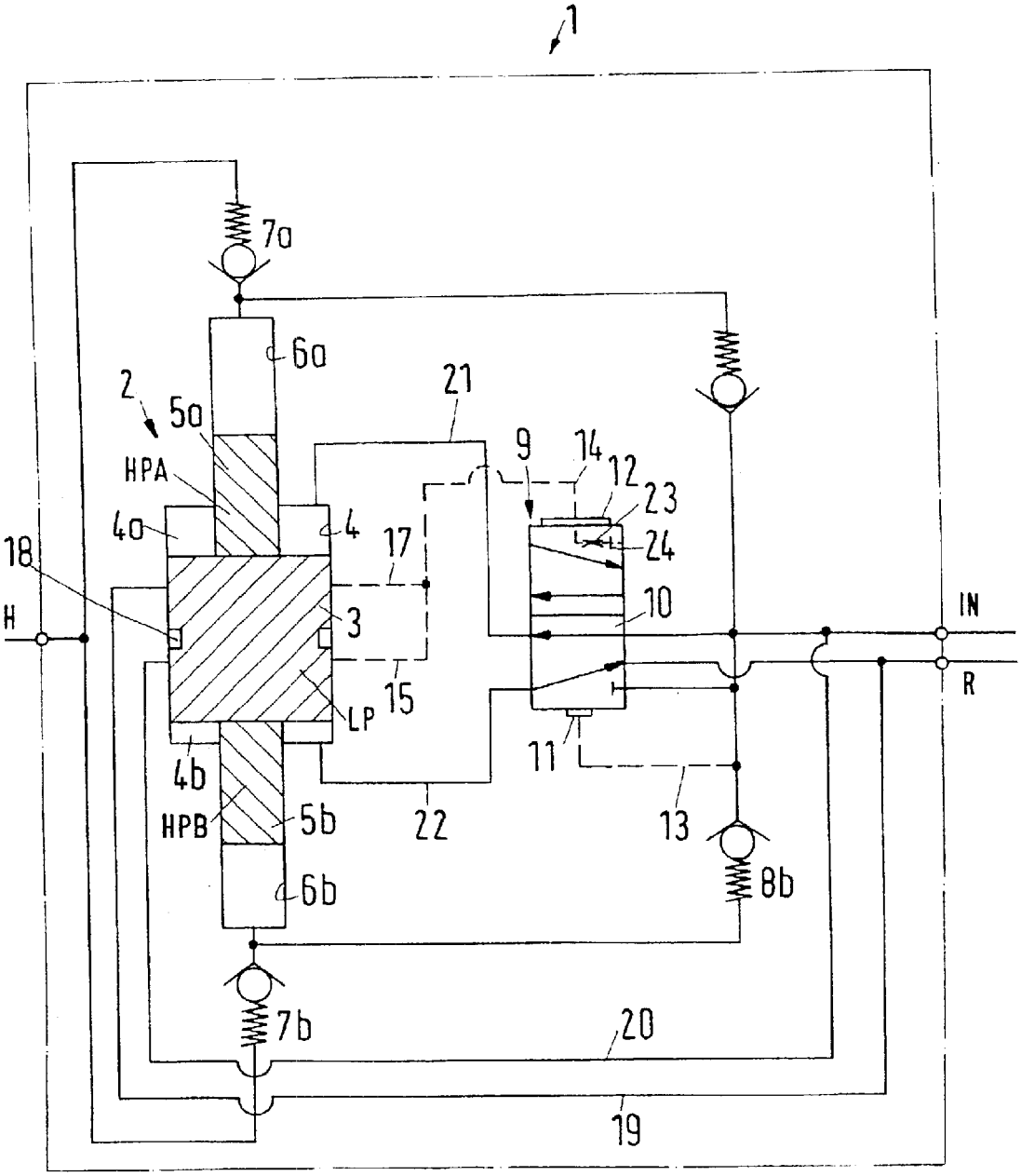
FIG. 3 is a schematic view of a third embodiment of a double-acting hydraulic pressure intensifier.

FIG. 3 shows a third embodiment in which identical and corresponding parts are given the same reference numbers.

The construction of the second pilot line 14 has changed. In the branch 15 a non-return valve 16 is now no longer provided. In return, an additional line 20 is provided between the supply connection IN and the low-pressure cylinder 4. The line 20 opens out into the low-pressure cylinder 4 in such a way that the groove 18 on the low-pressure piston 3 in an end position of the low-pressure piston 3 can make a connection between the line 20 and the branch 15 of the second pilot line 14. As soon as this connection is made, the valve element 10 is displaced into its position not shown in FIG. 3, this being under the action of the pressure in the second control pressure chamber 12 which acts on a larger pressure application area than in the first control pressure chamber 11 and corresponds to the pressure at the supply connection IN. The pressure in the second control pressure chamber 12 is then maintained via the stop plug 23, even when the low-pressure piston 3 moves upwards again and interrupts the connection between the line 20 and the branch 15 of the second pilot line 14.

The pressure in the second control pressure chamber 12 remains at the level of the supply connection IN until the groove 18 comes into alignment with the second branch 17 of the second pilot line 14 and short-circuits this branch 17 with the return line 19. In this case the valve element 10 returns to the position shown in FIG. 3 again. A pressure increase in the second control pressure chamber 12 via the stop plug 23 no longer takes place because the line 24 is shut off.

Figure 4:
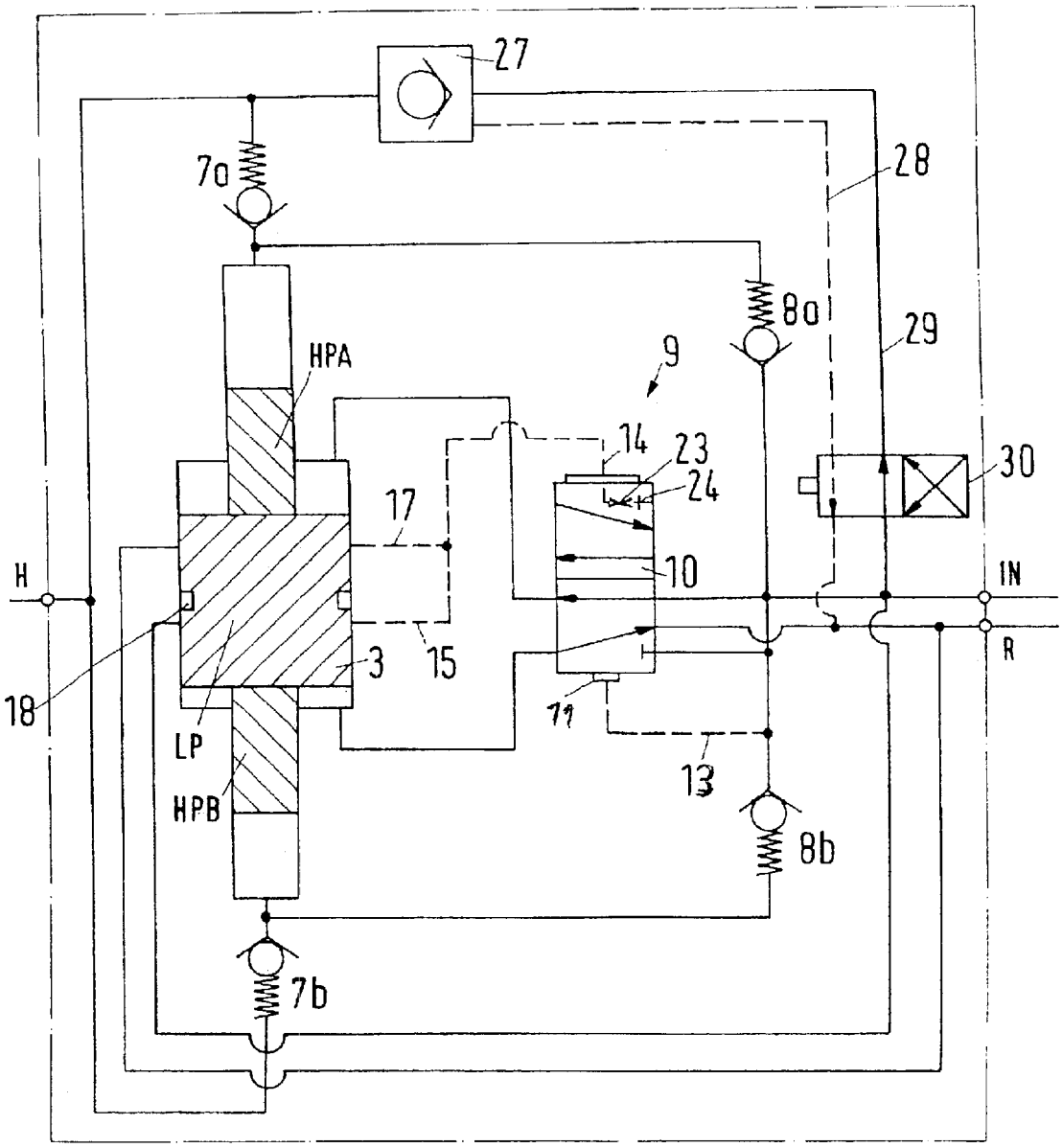
FIG. 4 is a schematic view of a fourth embodiment of a double-acting hydraulic pressure intensifier.

FIG. 4 shows a fourth embodiment in which identical parts are given the same reference numbers. This embodiment corresponds to the embodiment of FIG. 3.

In addition, a pilot-controlled non-return valve 27 is connected to the high-pressure connection H, which opens towards the high-pressure connection H. The non-return valve 27 can be actuated via a third pilot line 28. The non-return valve 27 is further connected to a drain line 29.

A drain valve 30 is installed in the third pilot line 28 and the drain line 29, this being in such a way that the third pilot line 28 is connected to the return connection R in the switching position of the drain valve 30 shown, while the drain line 29 is connected to the supply connection IN. The non-return valve 27 of this arrangement is not opened because the pressure at the supply connection IN is substantially lower than at the high-pressure connection H.

If however the drain valve 30 is actuated and adopts its other switching position, then the third pilot line 28 is connected to the supply connection IN and can thus open the non-return valve 27. The fluid then passes from the high-pressure connection H via the non-return valve 27 which is then open and the drain line 29 to the return connection R. With the pilot-controlled non-return valve 27 it is therefore possible to relieve the pressure of the high-pressure side of the pressure intensifier relatively rapidly.

Figure 5:
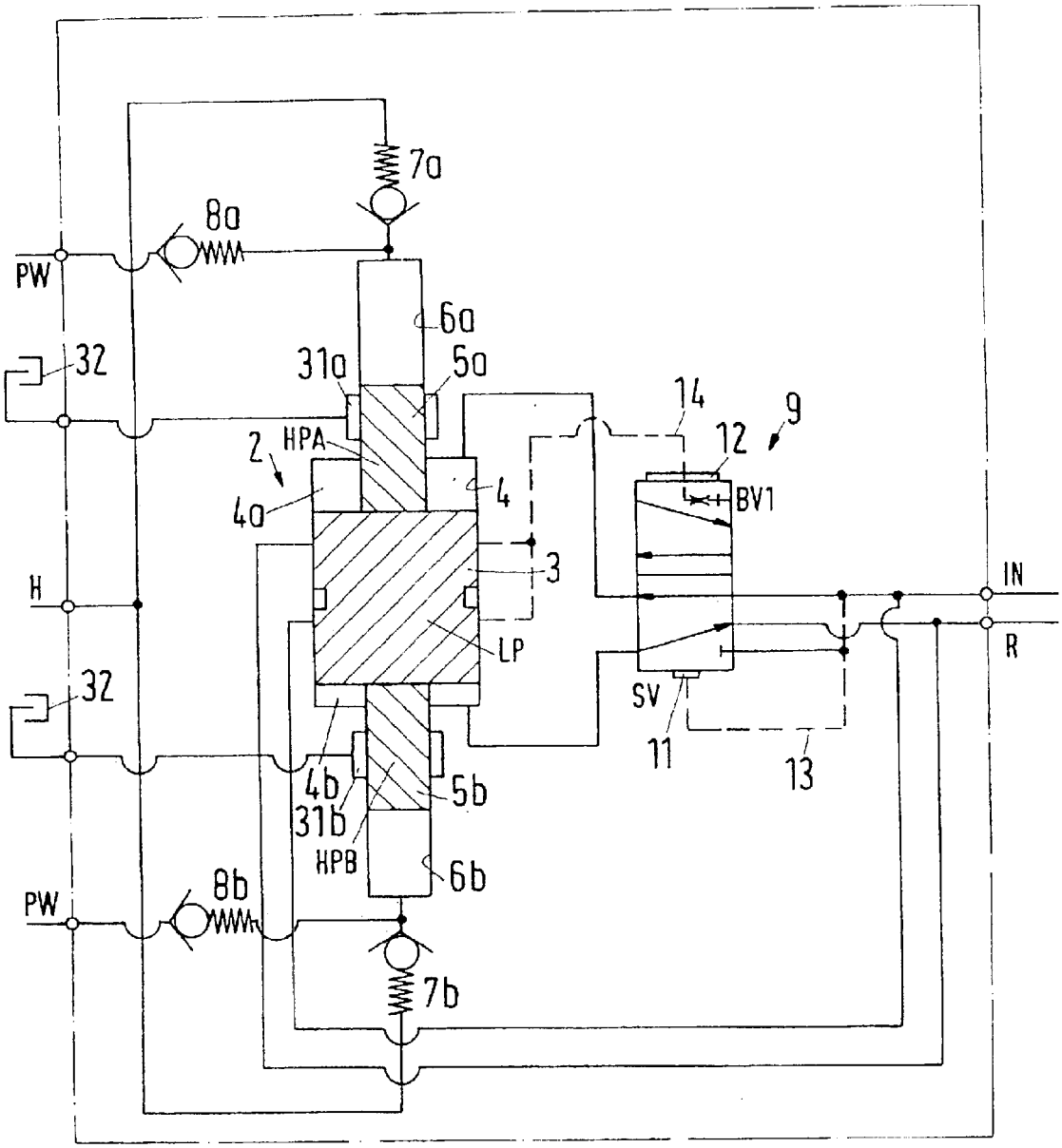
FIG. 5 is a schematic view of a fifth embodiment of a double-acting hydraulic pressure intensifier.

FIG. 5 shows a fifth embodiment which largely corresponds to the embodiment of FIG. 3. Identical and corresponding components are therefore given the same reference numbers.

Unlike the embodiment of FIG. 3, two fluid systems are now provided. These are a "drive system" which is confined to line conduction between the supply connection IN and the low-pressure cylinder 4 or between the low-pressure cylinder 4 and the return connection R. Also provided in this "supply system" is the switching valve assembly 9.

The other fluid system is located on the high-pressure side. It thus includes the two high-pressure cylinders 6*a*, 6*b* and the high-pressure connection H as well as the non-return valves 7*a*, 7*b*, 8*a*, 8*b*. Also provided are delivery connections PW with which the fluid, for example water which is to be raised to the higher pressure, can be delivered.

Between the two systems at each high-pressure cylinder 5*a*, 5*b* is provided a sealing assembly 31*a*, 31*b*, wherein the sealing assemblies 31*a*, 31*b* are connected to a third fluid system which is ultimately pressureless and comprises only one or more tanks 32. Fluids which have entered the sealing assemblies 31*a*, 31*b* can be drained via the tank 32. These can be both the fluid from the supply system, for example oil, and fluids from the second fluid system, for example water.

Figure 6:
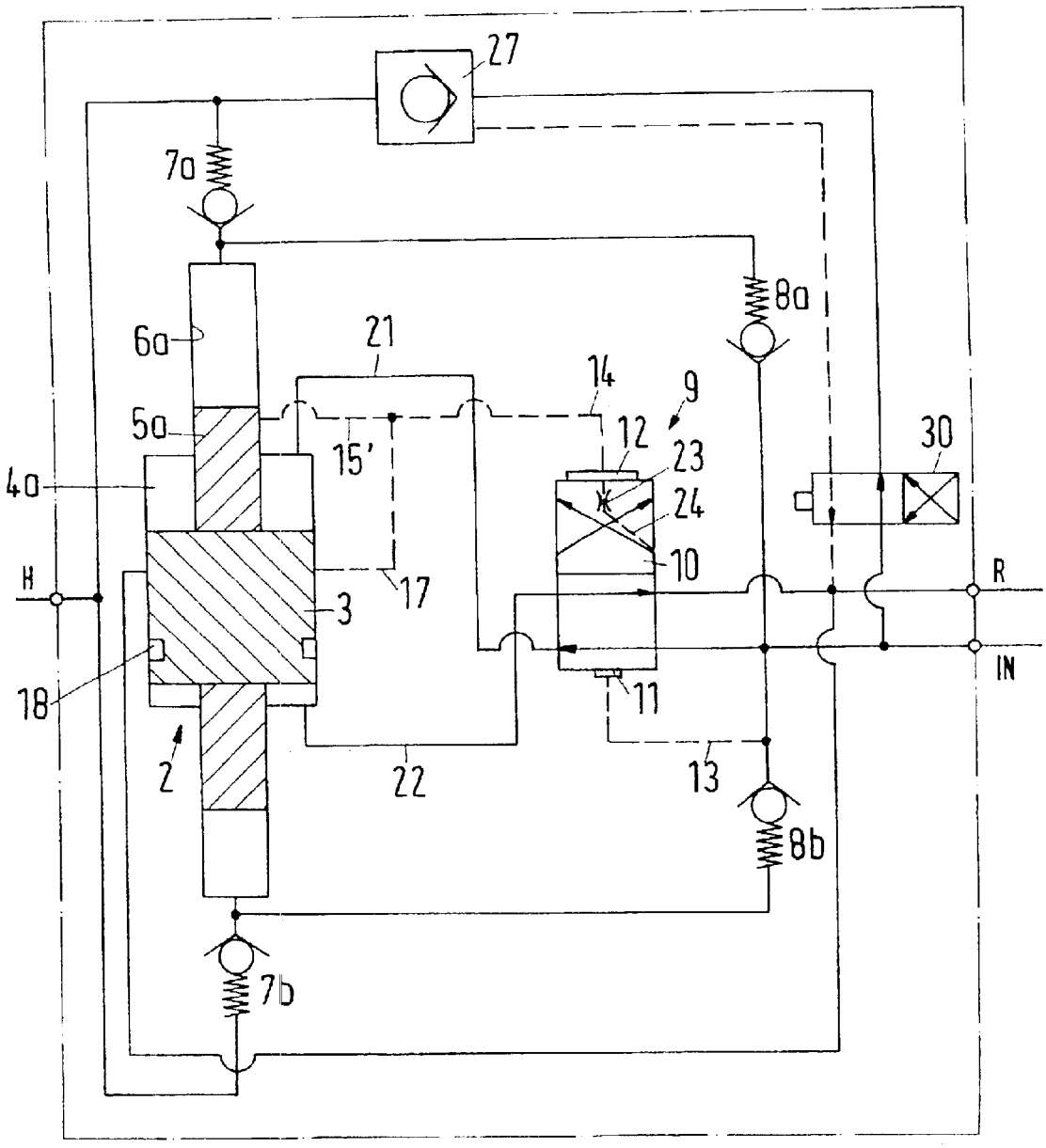
FIG. 6 is a schematic view of a sixth embodiment of a double-acting hydraulic pressure intensifier.

FIG. 6 shows a sixth embodiment of a double-acting pressure intensifier which essentially corresponds to the fourth embodiment of FIG. 4. Identical parts are therefore marked with the same reference numbers.

The essential difference lies in that switching of the valve element 10 of the switching valve assembly 9 from the position shown in FIG. 6 into the other position is no longer effected by a pressure which is delivered via the groove 18 in the low-pressure piston and hence via the low-pressure cylinder, but switching is effected via a line 15' which opens out in the high-pressure cylinder 6*a* and is cleared by the high-pressure piston 5*a* when the low-pressure piston 3 is in one end position in which the high-pressure cylinder 6*a* has its greatest volume. Hence there is no restriction to controlling the switching valve assembly 9 exclusively via the low-pressure side of the intensifying piston assembly 2.

Unlike the view of FIG. 4, in the embodiment of FIG. 6 the arrangement of the supply connection IN and return connection R is reversed. Accordingly, the line conduction inside and outside the switching valve assembly 9 has been altered correspondingly. But here too is provided the stop plug 23 which, when the supply connection IN is connected to the first low-pressure chamber 4*a*, is connected to the second control pressure chamber 12.

Figure 7:
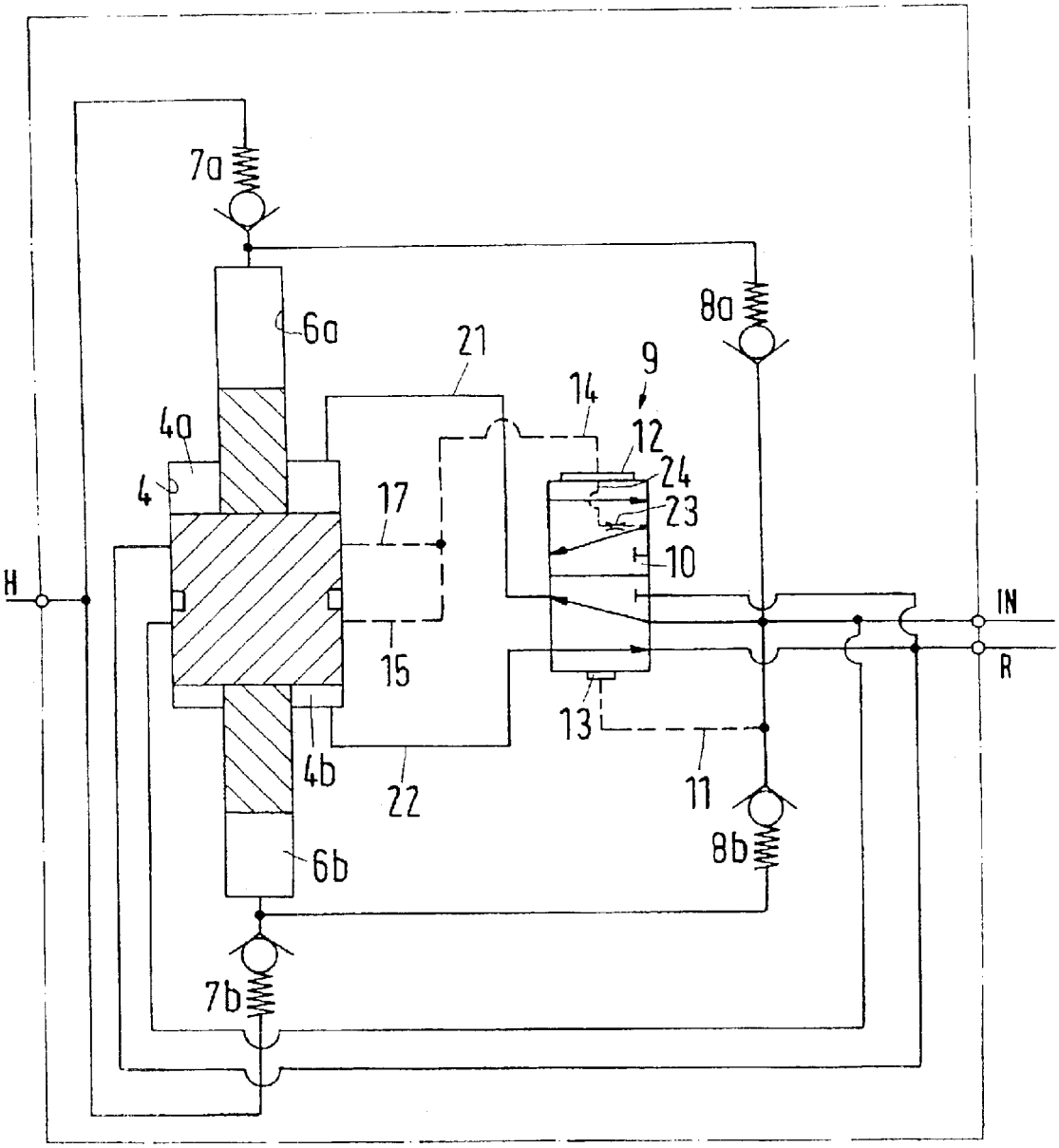
FIG. 7 is a schematic view of a seventh embodiment of a double-acting hydraulic pressure intensifier.

FIG. 7 shows a seventh embodiment which, except for the pilot-controlled non-return valve 27, essentially corresponds to the embodiment of FIG. 4. While in the embodiment of FIG. 4 the supply connection IN was split into two branches which supply two of three inputs of the switching valve assembly 9 and the third input of the switching valve assembly 9 is connected to the return connection R, here the design is reversed. The switching valve assembly 9 does likewise have three inputs. But only one of them is connected to the supply connection IN, while the other two are connected to the return connection R. Accordingly, the line 24 with the throttle 23 branches off from the path through the valve element, which in the actuated position of the valve element 10 (this position is not shown in FIG. 7) is connected to the supply connection IN.

Figure 8:
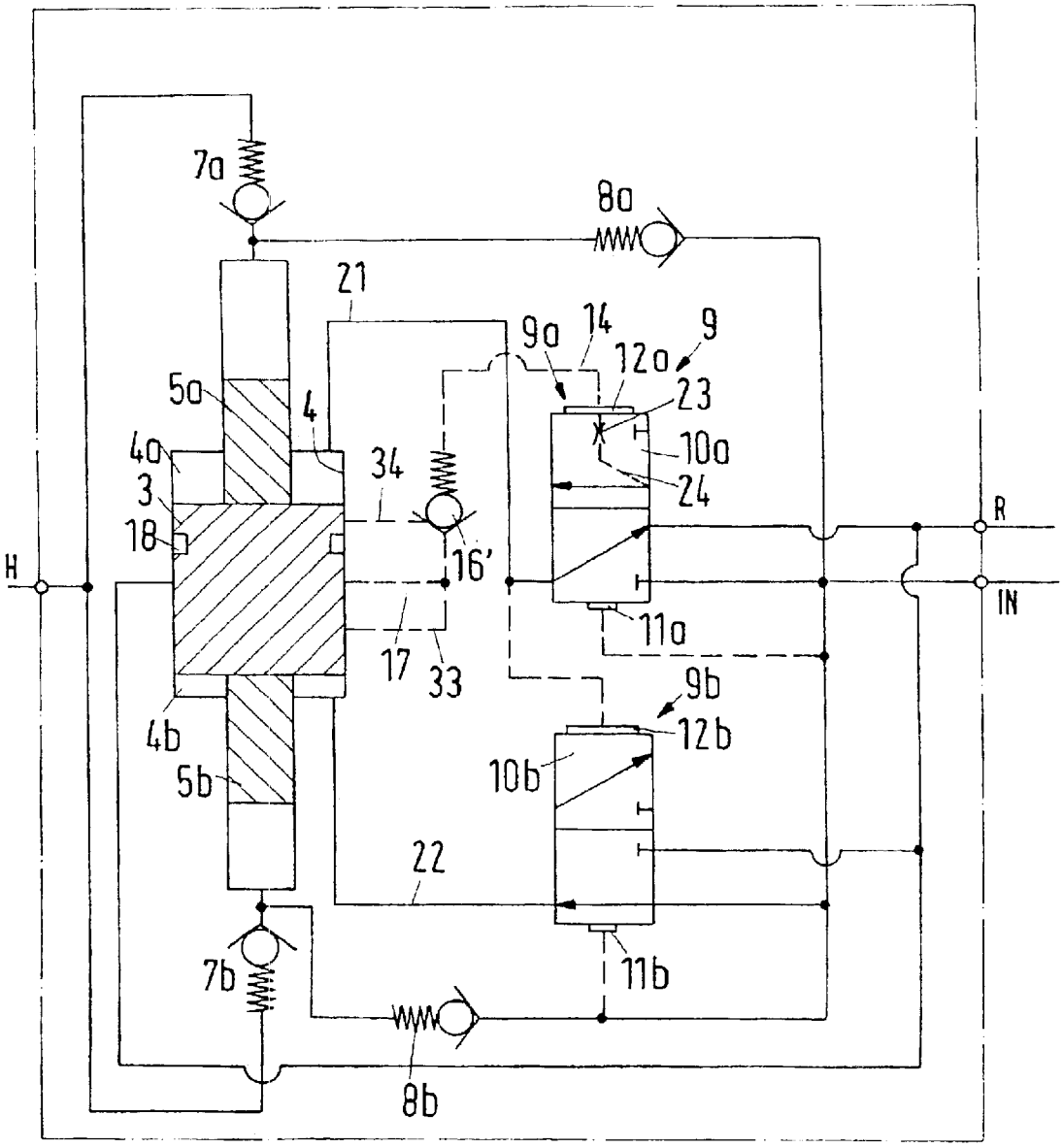
FIG. 8 is a schematic view of an eighth embodiment of a double-acting hydraulic pressure intensifier.

FIG. 8 shows an eighth embodiment in which the switching valve assembly 9 comprises two shuttle valves 9*a*, 9*b* each with its own valve element 10*a*, 10*b*. In other respects identical parts are given the same reference numbers.

When the two shuttle valves 9*a*, 9*b* are in the positions shown, then the second low-pressure chamber 4*b* is connected to the supply connection IN, while the first low-pressure chamber 4*a* is connected to the return connection R. The low-pressure piston 3 then travels upwards, reducing the first low-pressure chamber 4*a* in size, and in the region of one end position clears one branch 33 of the second pilot line 14, so that the non-return valve 16' is opened and the second control pressure chamber 12*a* of the shuttle valve 9*a* is supplied with pressure. The valve element 10*a* then changes its position and connects the supply connection IN to the first low-pressure chamber 4*a*. At the same time the pressure from the supply connection IN passes into the second control pressure chamber 12*b* of the second shuttle valve 9*b*. It should be noted here that this pressurization does not take place until after the first shuttle valve 9*a* has switched. Basically, a time delay has been introduced as a result, so that for a short time the pressure from the supply connection IN prevails on both sides of the low-pressure piston 3. This has two advantages. First, more precise switching is possible. Second, this arrangement has a damping effect on the movements of the low-pressure piston 3.

When the second control pressure chamber 12*b* has been pressurized, it displaces the valve element lob of the shuttle valve 9*b* in such a way that the second low-pressure chamber 4*b* becomes connected to the return connection R. The low-pressure piston 3 then moves downwards, i.e. it reduces the size of the second low-pressure chamber 4*b*. When the low-pressure piston 3 has almost reached its end position in this respect, the low-pressure piston 3 clears a valve control line 34 of the non-return valve 16' which for this purpose is designed as a pilot-controlled non-return valve. At the same time the groove 18 comes into alignment with the branch 17 of the second pilot line 14 and accordingly connects the second pilot line 14 via the now open pilot-controlled non-return valve 16' to the return connection R.

The advantage of this embodiment lies in that the branch point between the individual branches 17, 33 of the second pilot line 14 can be placed between the non-return valve 16' and the low-pressure cylinder 4. As a result, a very compact construction can be achieved.

When the second control pressure chamber 12*a* has been relieved of pressure, then the valve element 10*a* moves into the position shown in FIG. 8 and also connects the second control pressure chamber 12*b* of the second shuttle valve 9*b* to the return connection R. Here too, therefore, a time delay during switching is set up.

The invention is not limited by the embodiments described above which are presented as examples only but can be modified in various ways within the scope of protection defined by the appended patent claims.

We claim:

1. A double-acting hydraulic pressure intensifier comprising a supply connection, a return connection, and a high-pressure connection, an intensifier piston assembly comprising a low-pressure piston arranged in a low-pressure cylinder and two high-pressure pistons connected to the low-pressure piston and each arranged in a high-pressure cylinder, a switching valve assembly comprising a displaceable, hydraulically controlled valve element having on two opposite sides in a direction of displacement first and second control pressure chambers with pressure application areas of different sizes, wherein the first control pressure chamber has a smaller pressure application area and the second control pressure chamber has a larger pressure application area, and a stop plug arranged between the second control pressure chamber and the supply connection.

2. The pressure intensifier according to claim 1, wherein the stop plug is arranged in a line which can be shut off.

3. The pressure intensifier according to claim 2, wherein the valve element is configured to control the line which can be shut off.

4. The pressure intensifier according to claim 1, wherein the stop plug is arranged in the valve element.

5. The pressure intensifier according to claim 4, wherein the stop plug is configured to open out into the larger pressure application area and into a circumferential wall of the valve element.

6. The pressure intensifier according to claim 5, wherein the valve element is movable between a first position and a second position, and wherein the valve element when in the first position provides three flow paths, and when in a second position provides two flow paths, wherein one of the three flow paths comprises the stop plug.

7. The pressure intensifier according to claim 1, wherein the low-pressure piston is configured to act as a control element for the switching valve assembly.

8. The pressure intensifier according to claim 7, wherein the low-pressure piston comprises an auxiliary channel which, in one position of the low-pressure piston, connects the second control pressure chamber to the return connection.

9. The pressure intensifier according to claim 8, further comprising a control line with a non-return valve connecting the second control pressure chamber to the low-pressure cylinder, wherein the low-pressure piston clears the opening of the control pressure line into the low-pressure cylinder when the low-pressure cylinder is in a region of one of its end positions.

10. The pressure intensifier according to claim 9, comprising a pilot line and a pilot-controlled non-return valve arranged in the pilot line, wherein a valve control line of the non-return valve opens out into the low-pressure cylinder, and wherein the low-pressure piston clears the opening of the valve control line when the low-pressure piston is in another of its end positions.

* * * * *